United States Patent [19]

Till et al.

[11] 3,961,949

[45] June 8, 1976

[54] PHOTOELECTROPHORETIC IMAGING METHOD PRODUCING A DESIRED IMAGE BORDER

[75] Inventors: Henry R. Till; Percy Keith Watson, both of Rochester, N.Y.

[73] Assignee: Xerox Corporation, Stamford, Conn.

[22] Filed: Jan. 3, 1972

[21] Appl. No.: 214,936

[52] U.S. Cl. ..... 96/1 PE; 96/1.2; 204/181; 355/3 P; 355/4

[51] Int. Cl.[2] ..... G03G 17/04

[58] Field of Search ..... 96/1, 1.3, 1.2, 1 PE; 204/181 PE; 355/3, 4

[56] References Cited

UNITED STATES PATENTS

| | | | |
|---|---|---|---|
| 3,551,313 | 12/1970 | Walsh | 204/181 PE |
| 3,556,655 | 1/1971 | Lux et al. | 355/55 |
| 3,586,615 | 6/1971 | Carreira | 204/181 PE |
| 3,645,874 | 2/1972 | Wells | 204/181 PE |
| 3,671,121 | 6/1972 | Albert | 96/1 R X |
| 3,676,313 | 7/1972 | Ciccarelli | 204/181 PE |
| 3,679,453 | 7/1972 | Katagiri et al. | 204/181 PE |
| 3,687,538 | 8/1972 | Matsumoto | 355/3 |
| 3,715,209 | 2/1973 | Gundlach | 96/1.2 |

*Primary Examiner*—David Klein
*Assistant Examiner*—John R. Miller

[57] ABSTRACT

In a photoelectrophoretic imaging system, a field established between first and second electrodes is modified in a manner for substantially reducing the field between these electrodes in an area in conformity with a desired border for an image being reproduced. In a particular arrangement, electrodes are arranged and positioned adjacent an insulating surface of the first electrode for discharging the charge accumulated at the surface and establishing the surface at a potential equal to the potential of the second electrode.

3 Claims, 4 Drawing Figures

PHOTOELECTROPHORETIC IMAGING METHOD PRODUCING A DESIRED IMAGE BORDER

This invention relates to photoelectrophoretic imaging systems. The invention relates more particularly to improvements in finishing a reproduced image.

In a photoelectrophoretic imaging process a suspension of photosensitive pigmented particles and a carrier liquid is positioned between first and second electrodes. In one embodiment of this process the particles are subjected to activating electromagnetic radiation in imagewise configuration while an electric field is simultaneously established between the electrodes. The exposed pigment particles migrate through the liquid toward the first electrode and adhere to a receiving surface at this electrode. In one arrangement, an image remaining on the second electrode after the migration is complete is transferred to an image record medium. This transfer is accomplished by positioning an image record medium between the first and second electrodes and reapplying a potential which is opposite in polarity to the potential applied during the imaging process. The particles forming the image on the second electrode then migrate to this receiving body.

The reproduced image exhibits a relatively irregular and nondistinct outline. In certain applications such as photoreproduction, for example, it is preferable to form an image which has clear and distinct borders.

Accordingly, it is an object of this invention to provide a method and apparatus for establishing clear and distinct borders for a reproduced image in a photoelectrophoretic reproduction system.

Another object of the invention is to provide a relatively noncomplex and relatively inexpensive method and apparatus for establishing clear and distinct borders for a reproduced image in a photoelectrophoretic reproduction system.

In accordance with the general features of this invention, the field established between first and second electrodes in a photoelectrophoretic reproduction system is modified in a manner for substantially reducing the field between these electrodes in conformity with a desired border for an image being reproduced. In a particular embodiment of the invention, means including a contact electrode is provided and positioned adjacent an electrically insulating surface of one of the electrodes for selectively establishing a potential at this medium which substantially reduces the field between the first and second electrodes in conformity with a desired border configuration. These and other features of this invention will become apparent with reference to the following specification and drawings wherein:

Figure 1:
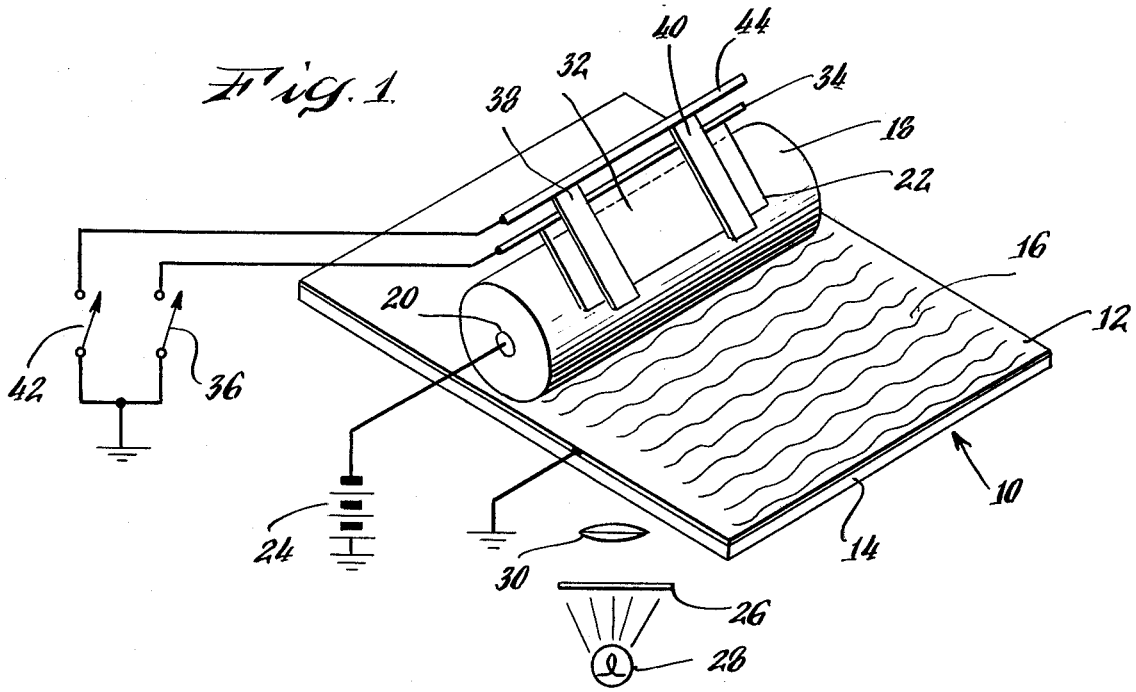
FIG. 1 is a perspective view of one embodiment of an electrophoretic reproduction apparatus constructed in accordance with features of this invention.

Referring now to FIG. 1, there is illustrated, schematically, an apparatus for performing an imaging step in a photoelectrophoretic imaging process. The apparatus includes a first electrode body 10 termed an injecting electrode in an electrophoretic system. The body 10 comprises an optically transparent substrate 14 coated with a thin layer 12 of transparent conducting material. The body 10 comprises by way of example a transparent electrically conductive film 12 of tin oxide deposited on a transparent support member 14 formed of glass. This assembly is known commercially as NESA glass. There is deposited on the surface 12, a suspension 16 of photosensitive pigmented particles disposed in an electrically insulating carrier liquid. While a number of different suitable suspensions are known and are described in detail in the U.S. Patents referred to hereinafter, one typical suspension comprises a mixture of Phthalocyanine and Watchung Red disposed in a kerosene carrier liquid. A second electrode comprising cylinder 18, adapted for rolling motion over the suspension 16, is formed of a central electrically conductive core 20 and an outer sleeve 22 of electrically insulating material. This cylinder is generally termed a blocking electrode in a photoelectrophoretic system. A D.C. potential is established between the conductive surface 12 and the cylinder core 20 by a battery 24 which is coupled between these elements through a ground connection. An object image which is to be reproduced is provided by a transparency 26 which is positioned between a light source 28 and a lens system 30. The transparency is illuminated and the image is projected toward the transparent electrode 10. The cylinder 18 is rotably transported across the surface 12 as the image is simultaneously projected toward the transparent electrode 10. A charge on those photosensitive particles which have been exposed by the image projection is altered by the exposure and these particles under the influence of the electric field established between the injecting and blocking electrodes migrate toward the blocking electrode 18. The particles which thus migrate become affixed to the sleeve 22 and establish in one embodiment a negative image of the projected image. A complementary positive image configuration is formed on the conductive surface 12. The positive image can be fixed on the surface or alternatively it can be transferred to a receiving surface by adhesive pick-up, for example, or electrostatic transfer. An extensive and detailed description of the photoelectrophoretic process is found in U.S. Pat. Nos. 3,384,565 and 3,384,484 to Tulagin and Carraira, 3,383,993 to Yeh, 3,384,566 to Clark. The disclosures contained in these patents are expressly incorporated by reference into the present specification.

In accordance with features of this invention, a method and means are provided for altering the electrostatic field between the injecting and blocking electrodes in order to control the transfer of pigment material between these electrodes. The field is modified in accordance with a geometrical configuration for providing a desired border for an image being reproduced. In the imaging arrangement illustrated in FIG. 1, a contact electrode 32 comprising a wiper blade formed of a strip of spring metal, for example, is aligned with and supported in electrical contact against the electrically insulating surface 22 of the cylinder 18. This electrode is employed for establishing two parallel spaced apart borders for an image being reproduced. The electrode 32 can be coupled to a desired potential, shown to be ground potential, by a support and contact rod 34, a switch 36, and wiring for coupling the switch between ground potential as shown and the contact rod 34. Alternatively, the electrode 32 is formed of a conductive brush or conductive spring. A second electrode arrangement comprising a pair of wiper blade electrodes 38 and 40 is provided for establishing parallel borders in a direction normal to the borders formed by the strip 32. The electrodes 38 and 40 are similarly formed of a metal such as spring brass and are positioned in electrical contact adjacent the insulating sleeve 22 of the cylinder 18. These electrodes are electrically insulated from the electrode 32 by an air spacing or alternatively by an insulating sheet positioned therebetween. A switch 42 is provided for establishing a potential on these electrodes through wiring which is coupled to an electrode rod 44 and to ground potential. The conductive coating 12 of the NESA body 10 is also maintained at ground potential.

As indicated hereinbefore, the cylinder 18 is rotably transported along the surface 12 for providing an imaging electric field. During this operation, the insulating sleeve 22 of the blocking electrode exhibits a surface charge which, with the applied potential of FIG. 1, is relatively negative with respect to the coating 12 of the transparent electrode 10. Accordingly those photosensitive pigment particles of the suspension 16 which have acquired a positive charge as a result of activating radiation during exposure, will migrate through the insulating carrier liquid toward this blocking electrode and form a negative image which adheres to the surface 22 of the blocking electrode. The electrode 32 and the electrode pair 38 and 40 are arranged, as illustrated in FIG. 1 in accordance with one embodiment of the invention, for altering the charge pattern on the insulating sleeve 22 as the cylinder progresses along the surface 12. As indicated hereinbefore, the surface 22 exhibits a relatively negative charge with respect to the surface 12. By selectively coupling the electrode 32 and the electrode pair 38 and 40 to ground potential, this negative surface charge is discharged and the blocking electrode in the area adjacent these electrodes exhibits a potential at or near ground potential. Since the surface 12 is also maintained at ground potential, a potential gradient does not exist between the injecting and blocking electrodes in the limited areas selectively defined by the electrode 32 and the electrode pair 38 and 40. The pigments in the suspension 16 will therefore not migrate to the surface in the area defined by these electrodes on the blocking electrode but will remain in suspension near the surface 12 of the NESA body. During this imaging step, the motion of the blocking electrode 18 across the NESA surface 12 forces the remaining pigments in suspension off the NESA surface in those areas traversed by the blocking electrode.

A desired bordering or framing of an image is accomplished by selectively operating the switches 36 and 42 in order to discharge the charge on surface 22 and inhibit the establishment of a field between the blocking and injecting electrodes in the selected areas. For example, parallel edges are established by momentarily closing the switch 36 as the blocking electrode cylinder 18 initiates its travel. This switch is then opened and the switch 42 is coincidentally closed and finally near the end of cylinder travel the switch 42 is opened coincidentally with the closure of the switch 36. The operation of these switches and the motion of the blocking electrode 18 thereby defines a rectangular bordered image which will have a white border upon transfer.

Although the formation of borders in accordance with the invention has been described with reference to FIG. 1 as being performed during the imaging process, it is equally well performed during a transfer process wherein the polarity of the potential applied between the injecting and blocking electrodes is reversed and the complementary image remaining on the injecting electrode is transferred to the blocking electrode. In addition, the formation of well defined borders can be accomplished during a cleanup process when a cleanup roller is transported across the image area. Furthermore, while the transparent electrode 10 has been shown as a satisfactory electrode and the blocking electrode as a transparent electrode, the converse arrangement can be employed wherein the transparented electrode comprises a tubular transparent body having a transparent outer conductive film and an imaging source positioned within and transported with the transparent electrode. In this embodiment, the contact electrode is transported in contact with an electrical insulating film such as Mylar which is formed over the conductive film.

Figure 2:
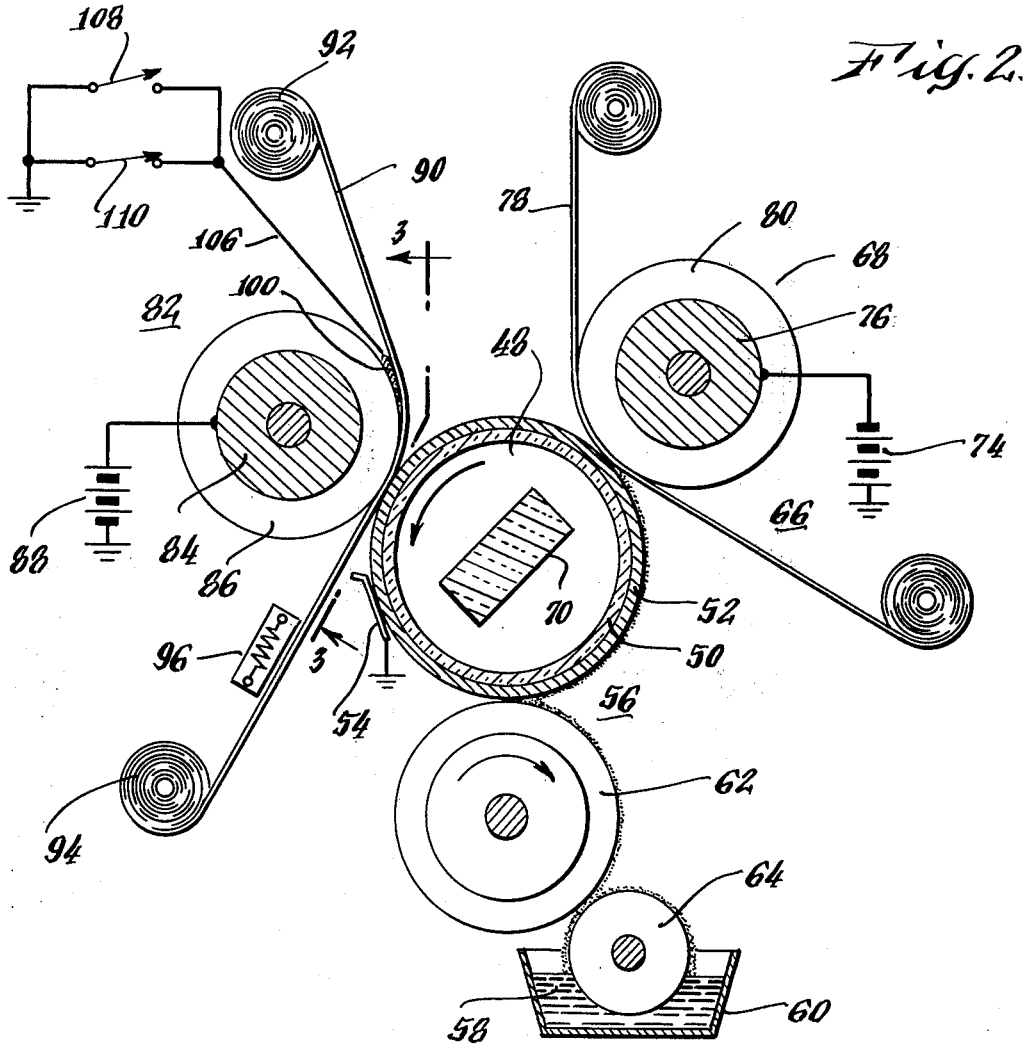
FIG. 2 is a schematic diagram of a polychromatic photoelectrophoretic system and including means for establishing well defined borders on a reproduced image in accordance with another embodiment of this invention.
Figure 3:
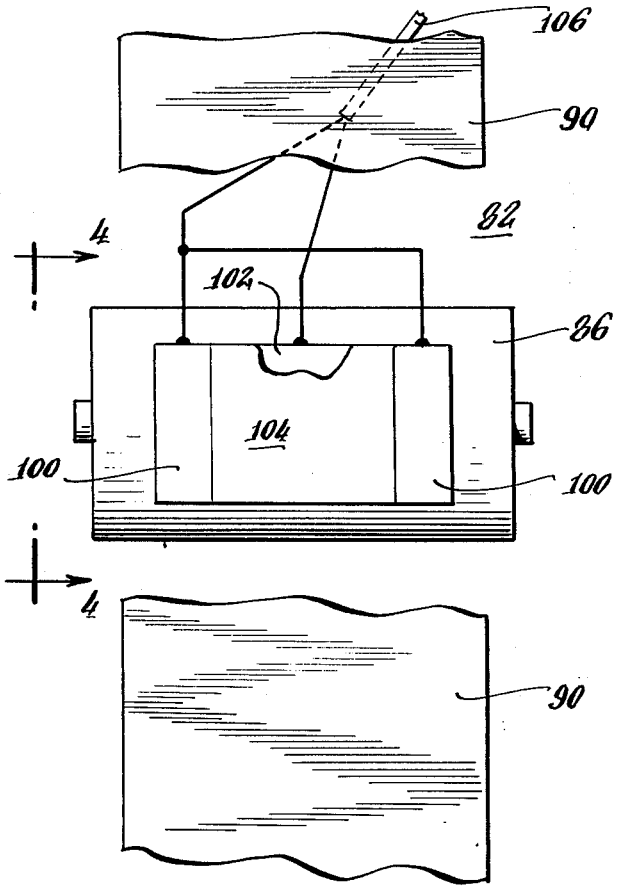
FIG. 3 is an enlarged view, partly broken away, taken along line 3—3 of FIG. 2 illustrating an electrode arrangement utilized for establishing well defined borders; and, FIG. 4 is an enlarged view taken along line 4—4 of FIG. 3 illustrating the relative arrangement of the electrodes of FIG. 2 for establishing the well defined borders in accordance with features of this invention.
Figure 4:
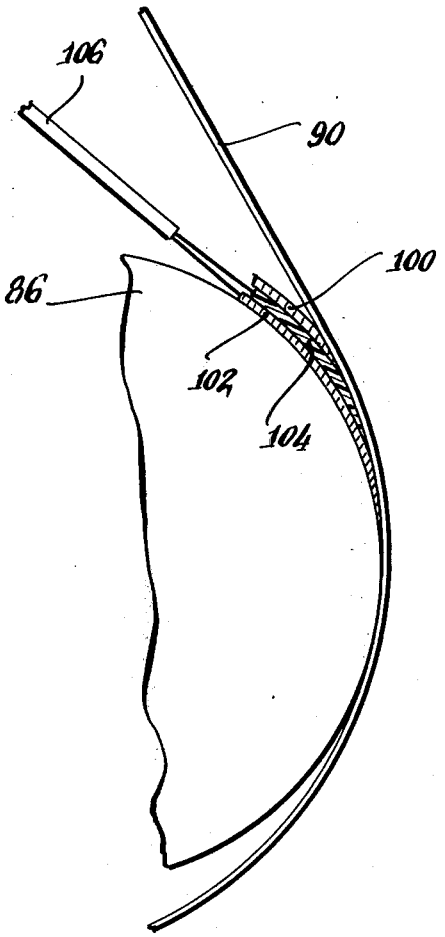

The features of this invention are applicable to both a monochromatic and polychromatic photoelectrophoretic system. FIGS. 2–4 illustrate a polychromatic photoelectrophoretic system incorporating the features of this invention. An imaging cylinder 48 is rotably mounted and driven in a counterclockwise direction as indicated. The cylinder 48 comprises a cylindrical body of transparent glass 50 which is overcoated with an electrically conductive material such as tin oxide. This layer 52 along with the layer 50 comprise a NESA glass cylinder. The conductive surface 52 which is maintained at ground potential by a sliding contact 54 is coated at an inking station 56 by a suspension of polychromatic pigmented particles in electrically insulating liquid. This material 58 is contained in a reservoir 60 and is applied to a coating cylinder 62 by an inking cylinder 64 which is disposed partly in the reservoir 60. The material 58 is transported to the inking station 56 at which location it is coated on to the imaging cylinder 48.

A polychromatic image is formed at an imaging or developing station 66 by establishing a potential between the imaging cylinder 48 and a blocking electrode 68. A lens 70 is centered within the imaging cylinder 48 and projects an image through the NESA glass and conductive surface 52 toward the material disposed on the outer surface of the cylinder. A potential is derived from a battery 74 and is applied to a conductive core 76 of the rotating blocking electrode 68. A strip of receiving paper 78 is fed between the material 58 on the imaging cylinder 48 and an insulating sleeve 80 which is positioned on the conductive core 76 of the blocking electrode 68. The photosensitive polychromatic pigmented particles migrate through the insulating liquid toward the blocking electrode and deposit on the receiving sheet 78. Those particles deposited on the sheet 78 constitute a negative color image in a subtractive color system.

A positive color image remaining on the surface of the imaging cylinder 48 is then rotated from the developing station 66 to a transfer station 82 at which station the positive image is transferred to a record medium. A second blocking electrode assembly comprising a conductive core body 84 and an insulating sleeve body 86 is provided at the transfer station 82. A negative transfer potential is applied between the conductive surface 52 of the imaging cylinder 48 and the conductive core 84 by a battery 88. The record medium to which a positive color image is transferred comprises a strip of paper 90 which is automatically fed between a supply reel 92 and a take-up reel 94. The image thus transferred is fixed on the paper by a heating element 96 disposed near the paper strip 90. As indicated, hereinbefore, the establishment of a negative potential between the conductive core 84 and the surface 52 causes the transfer of the polychromatic pigmented particles disposed on the surface 52 in the form of a positive image.

In order to inhibit the transfer of particles in a border area and to establish the desired borders on an image being reproduced, electrodes 100 an 102 are positioned adjacent the insulating sleeve 86 at the transfer station 82. These electrodes are shaped in order to conform to the circular outline of the insulating sleeve. A strip of suitable insulating material 104 (FIG. 3) is disposed between these electrodes and the assembly is mounted by means, not shown, to a stationary body, not shown, adjacent the sleeve 86. An electrical cable 106 couples the individual conductive wires from the electrodes 100 and 102 to switches 108 and 110 respectively. The switch 108 couples the electrode 100 to ground potential when closed while the switch 110 couples the electrode 102 to ground potential when closed. These switches can then be operated manually or automatically by cam driven elements, for example, in order to provide the desired borders for an image being reproduced.

The following illustrative example describes a preferred embodiment of the invention.

EXAMPLE 1

A photoelectrophoretic apparatus of the general type illustrated in FIG. 1 is provided wherein the suspension 16 comprises a mixture of phthalocyanine and Watchung Red in a kerosene carrier. The conductive film of the injection electrode is maintained at ground potential and a negative potential which is applied to the roller blocking electrode has a magnitude of approximately 2,000 volts. A metal strip contact electrode is supported in contact with an outer surface of the injection electrode and is transported therewith. The outer surface of the transport electrode comprises Mylar. The roller is transported at a rate of approximately 1 inch per second. Well defined lines are established on the Mylar surface of the transported electrode which represent areas where no charge is acquired.

Thus, we have described a relatively simple and noncomplex arrangement for establishing well defined borders for images being reproduced in a photoelectrophoretic imaging system. The invention is particularly useful in photo-reproduction techniques. Although we have described a particular polychromatic arrangement, it will be apparent that the invention is applicable to both monochromatic and polychromatic systems of the type referred to. In addition various other configurations can be employed by providing suitably shaped electrodes and controlling the potentials applied to these electrodes in accordance with a predetermined pattern.

While we have described and illustrated a particular embodiment of our invention, it will be understood that various modifications may be made therein without departing from the spirit of the invention and the scope of the appended claims.

What is claimed is:

1. A photoelectrophoretic imaging method comprising a. providing a flat transparent injecting electrode and a cylindrically shaped blocking electrode, b. providing a layer of imaging suspension on the surface of said injecting electrode, said suspension comprising a plurality of finely divided particles in an electrically insulating carrier liquid, each of said particles comprising an electrically photosensitive pigment;

c. bringing said blocking electrode into rolling virtual contact with said injecting electrode and establishing an electrical field across said suspension layer;

d. exposing said suspension to an imagewise pattern of activating electromagnetic radiation through said transparent injecting electrode; and e. substantially reducing the electrical field across said suspension in predetermined areas outside of and bordering the image area by contacting the areas of said blocking electrode surface corresponding to said border areas with a conductive member biased to a potential which substantially reduces the electrical field in said border areas, wherein the particles in said suspension do not adhere to the surface of either electrode in said border areas, whereby complementary images having clearly defined borders are formed on the surfaces of said electrodes.

2. A photoelectrophoretic imaging method comprising a. providing a flat transparent injecting electrode and a cylindrically shaped blocking electrode;

b. providing a layer of imaging suspension on the surface of said injecting electrode, said suspension comprising a plurality of finely divided particles in an electrically insulating carrier liquid, each of said particles comprising an electrically photosensitive pigment;

c. bringing said blocking electrode into rolling virtual contact with said injecting electrode and establishing an electrical field across said suspension layer;

d. exposing said suspension to an imagewise pattern of activating electromagnetic radiation through said transparent injecting electrode; and e. removing the potential gradient across said suspension layer in predetermined areas outside of and bordering the image areas by contacting the areas of said blocking electrode surface corresponding to said border areas with a conductive member biased so as to establish a potential on said blocking electrode surface areas equal to the potential on corresponding areas of the injecting electrode surface, wherein the particles in said suspension do not adhere to the surface of either electrode in said border areas whereby complementary images having clearly defined borders are formed on the surfaces of said electrodes.

3. The method as defined in claim 2 wherein said injecting electrode is at ground potential and said conductive member is coupled to ground potential.

* * * * *